US006959662B1

(12) United States Patent
Moran et al.

(10) Patent No.: US 6,959,662 B1
(45) Date of Patent: Nov. 1, 2005

(54) SHANK SLIDE ANCHOR

(76) Inventors: Michael A. Moran, 9155 Lakeview Dr., New Port Richey, FL (US) 34654; Gail M. Moran, 9155 Lakeview Dr., New Port Richey, FL (US) 34654

( * ) Notice: Subject to any disclaimer, the term of this patent is extended or adjusted under 35 U.S.C. 154(b) by 0 days.

(21) Appl. No.: 10/682,159

(22) Filed: Oct. 9, 2003

Related U.S. Application Data

(60) Provisional application No. 60/417,459, filed on Oct. 10, 2002.

(51) Int. Cl.[7] ..... B63B 21/32
(52) U.S. Cl. ..... 114/304; 114/301
(58) Field of Search ..... 114/301–309

(56) References Cited

U.S. PATENT DOCUMENTS 180,374 A * 1/1876 Robinson ..... 114/299
3,111,107 A * 11/1963 Harold et al. ..... 114/299
3,430,596 A * 3/1969 Hysaw ..... 114/298

* cited by examiner

*Primary Examiner*—Ed Swinehart
(74) *Attorney, Agent, or Firm*—Stanley M. Miller

(57) ABSTRACT

An elongate shank has a trailing end adapted to be secured to an anchor. A slide sleeve ensleeves the shank, is slideable along its extent, and is rotatable about its longitudinal axis. A leading end of the shank is capped to prevent slide sleeve disengagement. A radially extending apertured tab is secured to the slide sleeve. A continuous loop member adapted to be engaged by an anchor chain extends through the aperture. A vessel operator places tension on the anchor chain and passes over the anchor. The slide sleeve rotates about the longitudinal axis of the shank and slides along the length of the shank until stopped by the cap. The shank rotates to follow the path of travel of the vessel and the anchor is released from any obstacle to which it may be engaged.

7 Claims, 5 Drawing Sheets

SHANK SLIDE ANCHOR

CROSS-REFERENCE TO RELATED DISCLOSURE

This disclosure is a continuation-in-part of a provisional disclosure of the same title by the same inventors, Ser. No. 60/417,459, filed Oct. 10, 2002.

BACKGROUND OF THE INVENTION

1. Field of the Invention

This invention relates, generally, to anchors. More particularly, it relates to an anchor structure that disengages from underwater obstacles without causing appreciable damage to the obstacle.

2. Description of the Prior Art

Anchors sometimes become lodged in under water obstacles such as rocks, trees stumps, vegetation, debris, reef structures, and the like.

When an anchor of conventional design becomes stuck to an underwater obstacle, the boater typically tries circling the boat over the anchor so that the anchor can be pulled upon in all directions. Sometimes, with luck, the right angle of pull will be found and the anchor will release.

Sometimes the anchor does not disengage from the obstacle but merely pulls it up to the boat. Thus, retrieval of the anchor includes retrieval of the debris or other obstacle to which the anchor is engaged. The boat operator must then pull the anchor and the connected items on board and begin the work of separating the anchor from the unwanted items. When this happens, the vessel may become dirty and of course extra time is lost due to the chore.

An anchor engages to a coral reef cam also cause great harm to the reef, especially if it is retrieved by force, causing the reef to break.

What is needed is an anchor that is more easily dislodged from under water obstacles relative to a conventional anchor.

Moreover, there is a need for an anchor that not only dislodges easily from obstacles, but which can do so with minimum damage to the obstacle.

There is a need as well for an anchor retrieval structure that does not haul to the surface of the water the obstacle to which the anchor is engaged.

However, in view of the prior art considered as a whole at the time the present invention was made, it was not obvious to those of ordinary skill in the pertinent art how such need could be fulfilled.

SUMMARY OF THE INVENTION

The long-standing but heretofore unfulfilled need for an anchor that disengages itself from under water obstacles in a manner that compares favorably with conventional anchor structures, that minimizes damage to the obstacle during the disengagement process, and which does not carry the object to the boat when the anchor is retrieved is now met by a new, useful, and nonobvious invention.

The novel structure has utility with any anchor design.

In a first embodiment the novel structure is used with an anchor having a pair of parallel flukes that are interconnected to one another at their respective trailing ends to a straight rod. A pair of flares have respective leading ends secured to the straight rod and are circumferentially spaced from one another by ninety degrees (90°) and each flare is circumferentially spaced from its contiguous fluke by one hundred twenty degrees (120°).

A pivot sleeve ensleeves the straight rod, mid-length thereof, and is rotatable about the longitudinal axis of the straight rod.

The trailing end of a novel elongate shank is secured to the pivot shaft so that the elongate shank is free to rotate about the longitudinal axis of the straight rod when the inventive structure is in use.

In a second embodiment, the anchor structure includes no straight rod and thus there is no pivot sleeve. The novel elongate shank is secured directly to the anchor so that the entire anchor pivots as the elongate shank pivots.

In both embodiments, a slide sleeve ensleeves the elongate shank and is rotatable about the longitudinal axis of the elongate shank. Moreover, the slide sleeve is slideable along the extent of the elongate shank. A cap at the leading end of the elongate shank entraps the slide sleeve so that it cannot slide off said leading end.

In the first embodiment, the slide sleeve is prevented from sliding off the trailing end of the elongate shank by the pivot sleeve.

In the second embodiment, a bend is formed in the elongate shank near the trailing end thereof where the elongate shank is secured to the anchor and a second cap is secured to the elongate shank near the bend to prevent the slide sleeve from sliding onto the bent trailing end of the elongate shank.

In both embodiments, a flat tab is secured to and extends radially outwardly from the slide sleeve. An aperture is formed in the tab and the aperture is engaged by a continuous loop member that is also engaged to an anchor chain means. In other words, the anchor chain engages the loop member and the loop member engages the flat tab. Thus, as the slide sleeve slides in either direction along the extent of the elongate shank, the free end of the anchor chain means is displaced along the length of the elongate shank as well.

A vessel operator places tension on the anchor chain means and steers the vessel toward a point on the water directly above an anchor engaged to or otherwise snagged upon an under water obstacle. The slide sleeve is free to rotate about a longitudinal axis of the elongate shank. The slide sleeve is also free to slide along the length of the elongate shank until further sliding is prevented by the leading cap or pivot sleeve (first embodiment) or by the leading cap and the trailing cap (second embodiment).

The vessel continues along the same path of travel if the anchor does not release from the obstacle and passes directly over the anchor so that the vessel travels away from the anchor, thereby causing the pivot sleeve and hence the elongate shank to continue rotating about the longitudinal axis of the straight rod until an angle is found where the anchor is released from the obstacle.

If passing directly over the anchor fails to release it, a pass is made over the anchor, to the left or right side thereof, and the process is repeated so that the vessel passes over the anchor at differing angles until the anchor is released. The elongate shank is pointed generally toward the vessel as the vessel approaches the anchor and remains pointed at it as the vessel passes over head. Similarly, the slide sleeve is free to slide along the extent of the elongate shank and to rotate about said elongate shank as the elongate shank pivots with respect to the straight rod.

An important object of this invention is to provide an anchor that dislodges easily from under water obstructions.

Another important object is to provide an anchor that minimizes damage to the obstacle to which it is engaged at the moment of anchor release.

Another major object is to provide an anchor that releases itself from obstacles so that it does not pull such obstacles onto a boat when the anchor is retrieved.

Another object is to provide an anchor-releasing means that is adaptable to many different anchor designs.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
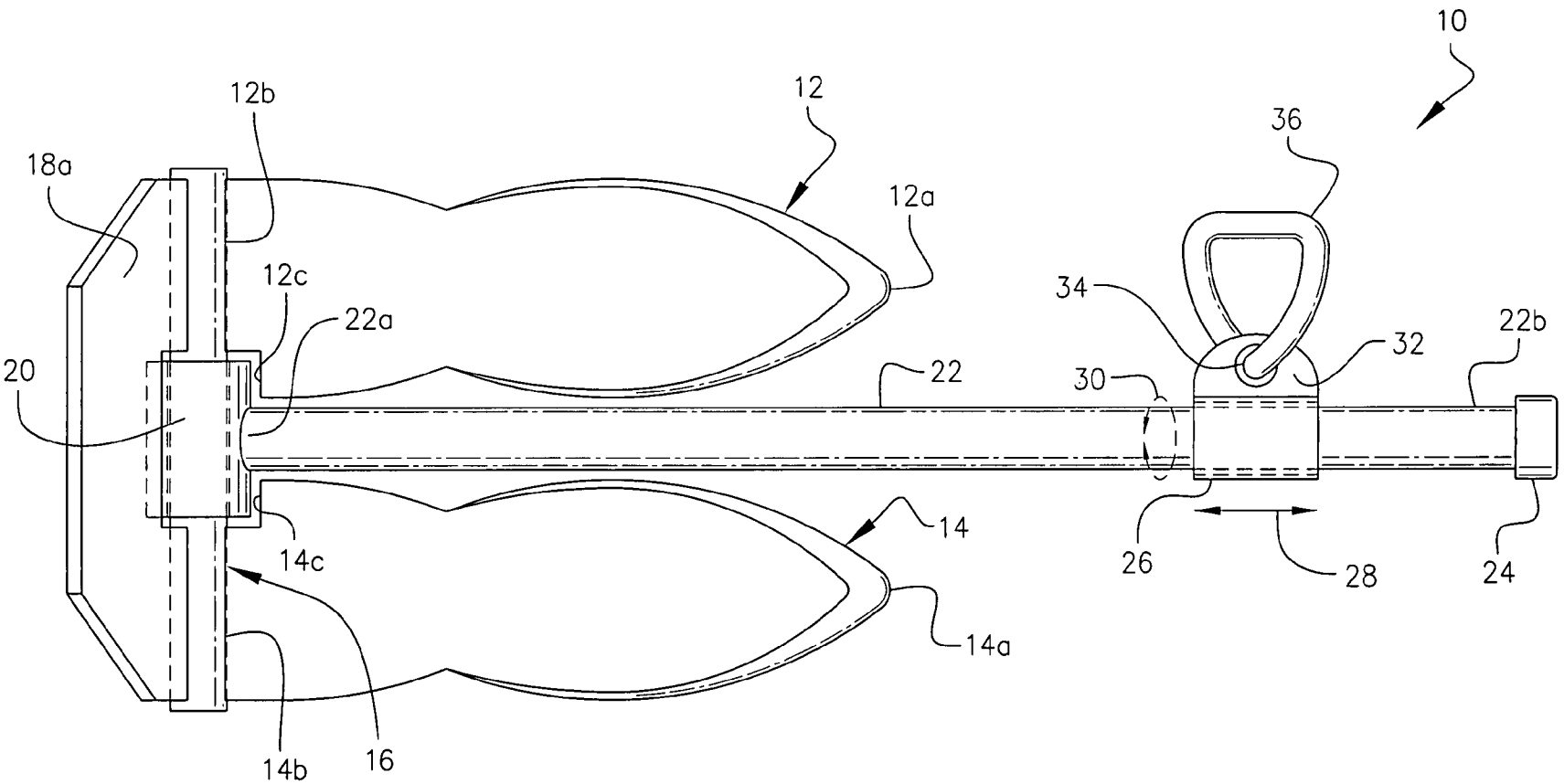
FIG. 1 is a top plan view of the novel anchor assembly when used with a first type of anchor.

Referring now to FIG. 1, it will there be seen that the reference numeral 10 denotes an illustrative embodiment of the present invention as a whole.

It is important to note from the outset that the present invention has utility with floating vessels of any type that employ anchors, whether such vessel is a recreational boat, a commercial fishing boat, a yacht, a commercial barge, ship, or the like.

It is equally important to note that the invention has utility in connection with anchor designs of all types, whether intended for use in rivers, lakes, or oceans. Although only two common anchors are shown in the attached drawings, the invention is not limited to the depicted anchors. The novel structure may be adapted to engage any anchor and will ease the extraction of any anchor from any type of under water obstacle.

Figure 2:
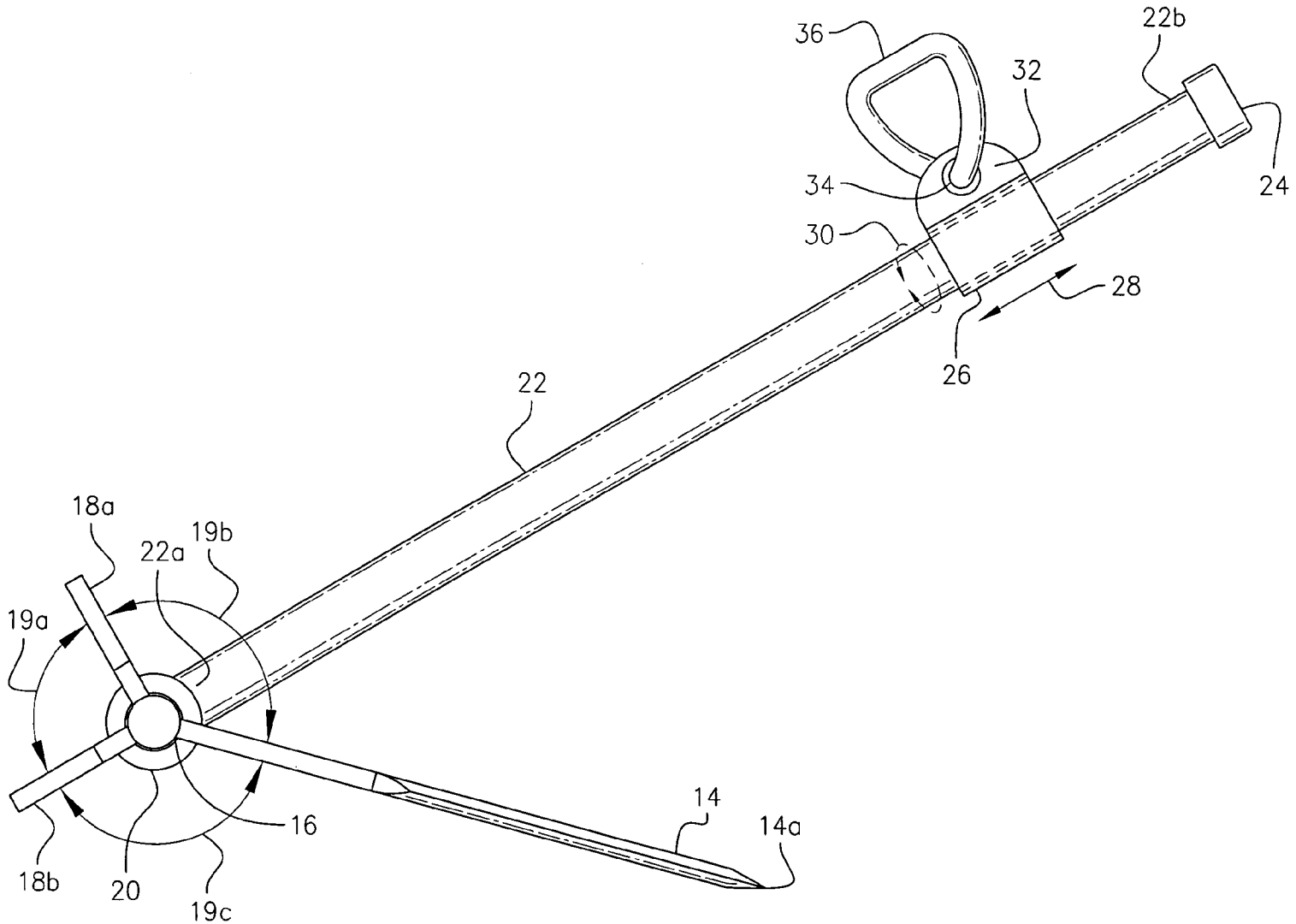
FIG. 2 is a side elevational view of the novel anchor assembly depicted in FIG. 1.

The anchor of FIGS. 1 and 2 has flukes 12, 14 having somewhat pointed leading end 12*a*, 14*a*, respectively, and flat trailing ends 12*b*, 14*b*, respectively.

Flat trailing ends 12*b*, 14*b* are welded or otherwise fixedly secured to straight rod 16, at opposite ends thereof.

As best understood in connection with FIG. 2, the respective leading ends of a first flare 18*a* and a second flare 18*b* are welded or otherwise fixedly secured to opposite ends of said straight rod 16 in circumferentially spaced apart relation to one another and in circumferentially spaced apart relation to flukes 12, 14.

First flare 18*a* is spaced ninety degree (90°) from second flare 18*b* as indicated by angle 19*a*. Accordingly, as indicated by angle 19*b*, first flair 18*a* is disposed at a one hundred thirty five degree (135°) angle relative to the plane of flukes 12, 14 and second flair 18*b*, as indicated by angle 19*c*, is also disposed at a one hundred thirty five degree (135°) angle relative to the plane of flukes 12, 14.

As best understood in connection with FIG. 1, pivot sleeve 20 is positioned mid-length of straight rod 16, and ensleeves straight rod 16 in pivotal relation thereto, i.e., pivot sleeve 20 is free to rotate about the longitudinal axis of straight rod 16. In this illustrative embodiment, the respective trailing ends of flutes 12, 14 are cut-away as at 12*c*, 14*c*, respectively, to accommodate said pivot sleeve 20.

The trailing end 22*a* of elongate shank 22 is welded or otherwise fixedly secured to pivot sleeve 20, mid-length thereof. In this particular embodiment, shank 22 is about sixteen inches in length but such dimension is not critical in that shank 22 may be made to extend to any desired length depending upon the size of the anchor with which it is used.

The leading end 22*b* of shank 22 is capped by cap or stop member 24 which is welded or otherwise fixedly secured to said leading end.

Slide sleeve 26 ensleeves shank 22 and is free to slide along the extent thereof in either direction as indicated by double-headed directional arrow 28. Slide sleeve 26 is also free to rotate about the longitudinal axis of shank 22 in either direction as indicated by double-headed directional arrow 30.

Flat tab 32 is welded or otherwise fixedly secured to slide sleeve 26 and extends therefrom in radial relation thereto. In this illustrative embodiment, it has a semicircular configuration so that it does not snag under water obstacles.

Tab 32 is centrally apertured as at 34 to receive loop member 36 to which an anchor chain, rope, or other elongate anchor-engaging means, not illustrated, is secured.

Novel anchor 10 is used in the conventional way if it is not snagged in any way. The anchor is retrieved by coiling the unillustrated anchor chain in the conventional way. However, if the anchor is engaged to an underwater obstacle and cannot be tugged therefrom, the vessel operator places tension on the anchor chain and travels directly toward the point on the water directly above the anchor. As the vessel approaches that point, the anchor chain is maintained under tension. Slide sleeve 26 rotates about the longitudinal axis of shank 22 and slides along the length of shank 22. Simultaneously, pivot sleeve 20 rotates about straight rod 16 and shank 22 rotates about the longitudinal axis of straight rod 16 to follow the path of travel of the vessel.

If the anchor does not release from the obstacle, the vessel continues along the same path of travel, it being understood that after the vessel passes directly over the anchor, it is traveling away from said anchor. Slide sleeve 26 slides along the extent of shank 22 until it is stopped from further sliding by cap member 24. Simultaneously, shank 22 continues to rotate about the longitudinal axis of straight rod 16, it being understood that tension is maintained in the anchor chain at all times.

If traveling directly toward and directly away from the anchor does not work, the vessel should pass over the anchor from either side thereof at differing distances until successful release is accomplished. The pivotal connection of shank 22 to straight rod 16 and the pivotal and sliding connection of slide sleeve 26 to said shank insures that the anchor will release from the obstacle upon being pulled from the correct angle.

In this way, shank 22 rotates through an angle that may approach one hundred eighty degrees (180°), depending upon the position of the anchor at the time of snagging and the shape and size of the obstacle. As shank 22 moves, and as slide sleeve 26 slides along its extent and rotates relative thereto, the anchor will disengage from the obstacle. Advantageously, any debris is swept from shank 22 by the travel of slide sleeve 26 so that the anchor will be clean when it reaches the vessel.

Figure 3:
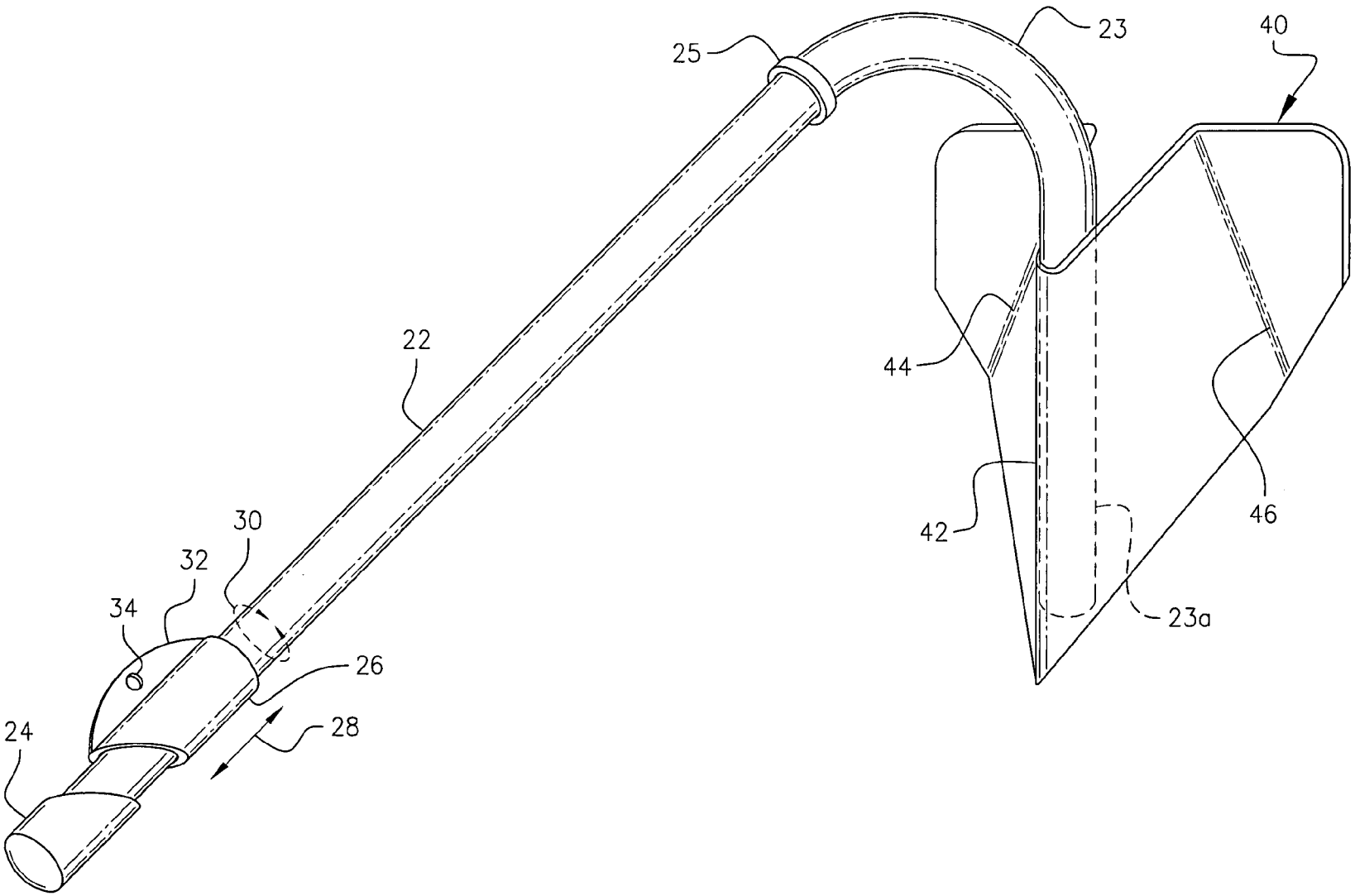
FIG. 3 is a perspective view of the novel anchor assembly when used with a second type of anchor.
Figure 4B:
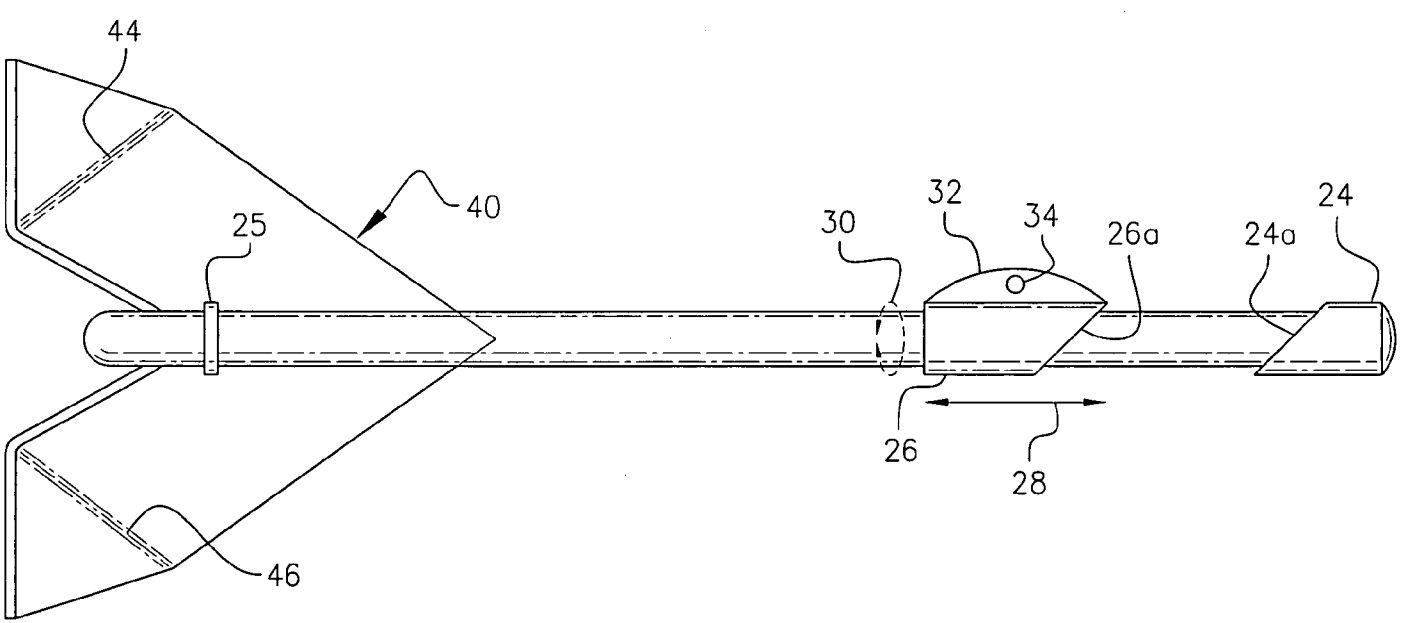
FIG. 4B is a top plan view of the FIG. 3 embodiment.
Figure 4A:
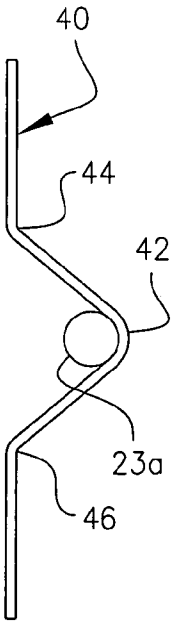
FIG. 4A is an end view of the structure depicted in FIG. 4B.

The structure depicted in FIGS. 3, 4A, 4B, and 5 operates in substantially the same way as the structure depicted in FIGS. 1 and 2. The anchor in these Figures is denoted 40. Anchor 40 is formed from an initially flat sheet of stainless steel or other suitable material. A "V"-shaped bend 42 is formed in said initially flat sheet along a central axis thereof so that the anchor is symmetrical about said "V"-shaped bend. A secondary bend 44, 46 is formed in each of the opposing halves of the anchor as depicted in FIGS. 3, 4A, and 4B.

As best understood in connection with FIG. 3, shank 22 has a bend 23 formed therein and a slide stop 25 is positioned at the beginning of said bend to stop travel of slide sleeve 26.

As indicated in the end view of FIG. 4A, the part of shank 22 that trails bend 23 is denoted 23*a* and is welded or otherwise fixedly secured to anchor 40 at the center of said anchor along said "V"-shaped bend 42.

Thus, in this second embodiment, the structure includes no straight rod 16, flares 18*a*, 18*b*, or pivot sleeve 20. The trailing part of elongate shank 22 is directly secured to anchor 40 and thus said anchor 40 moves conjointly therewith. The technique for freeing a trapped anchor is the same as in the first embodiment.

Figure 5:
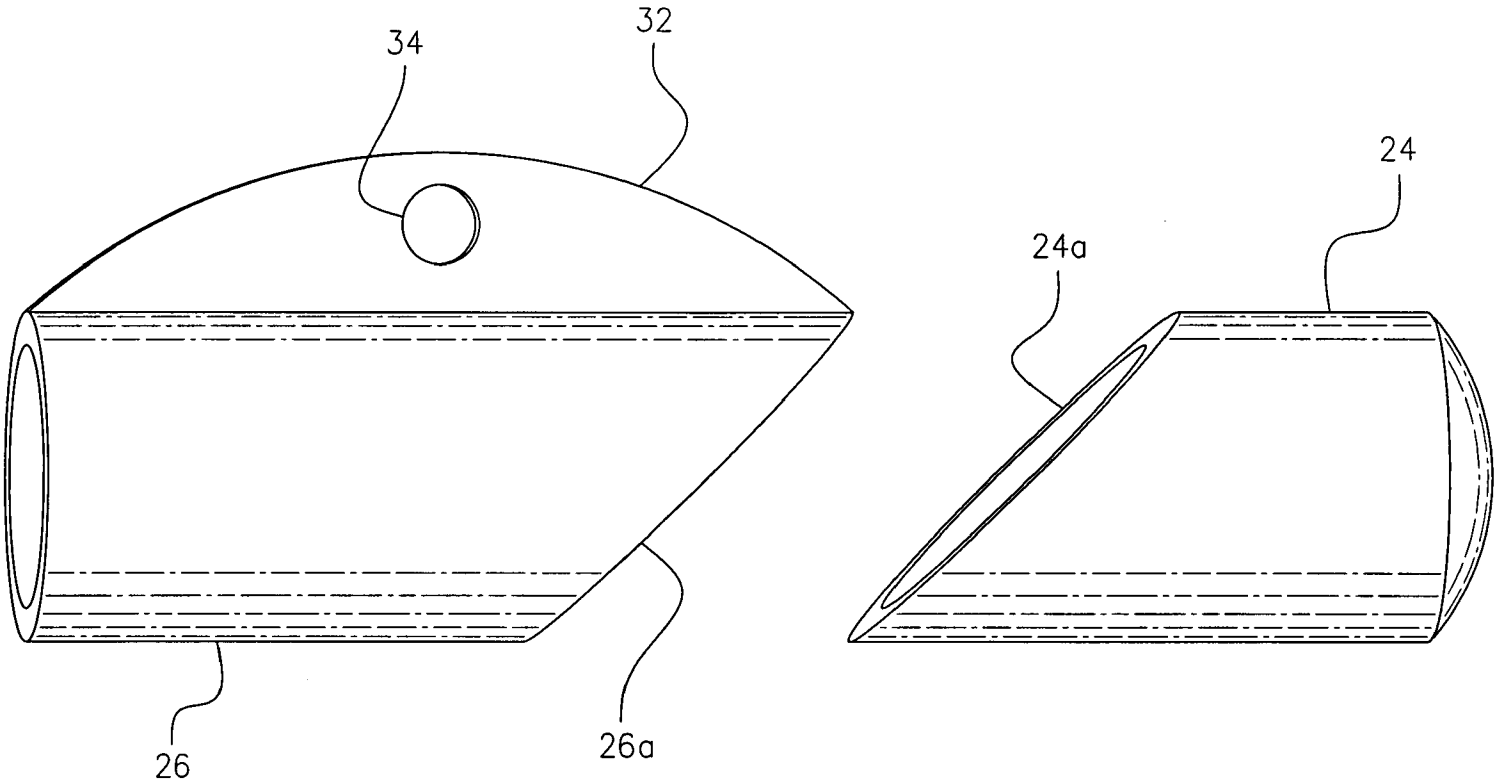
FIG. 5 is a side elevational view of the novel slide sleeve and cap of the FIG. 3 embodiment.

Note in FIGS. 4B and 5 that the leading end 26*a* of slide sleeve 26 and the trailing end 24*a* of cap member 24 are complementally beveled with respect to one another. This provides a mechanical advantage by increasing the surface area of the contacting surfaces when said leading end 26*a* is abuttingly engaged to said trailing end 24*a*.

This inventive assembly protects coral reefs from excess damage by enabling an anchor to become dislodged in the manner just described without breaking the coral. Older anchor-recovery techniques rely upon brute force and often result in a broken section of coral reef which can take a hundred years or more to grow back.

The novel anchor is preferably formed of stainless steel so that it does not corrode under the effects of sea water. However, the invention is not limited to any particular material. The novel structure could be made of other metals or alloys, high impact plastic, or the like. Thus, the various parts that are fixedly secured to one another could also be formed integrally with one another.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An anchor, comprising:

an elongate shank having a trailing end adapted to be secured to an anchor;

a slide sleeve that ensleeves said elongate shank;

said slide sleeve being slideable along the extent of said elongate shank;

said slide sleeve being rotatable about a longitudinal axis of said elongate shank;

a first cap secured to a leading end of said elongate shank to prevent disengagement of said slide sleeve from said elongate shank;

a tab secured to said slide sleeve, said tab projecting radially outwardly with respect to said longitudinal axis of said elongate shank;

an aperture formed in said tab;

a loop member that extends through said aperture, said loop member adapted to be engaged by an anchor chain means;

said anchor including a pair of flukes that are disposed substantially parallel to one another;

a transversely disposed straight rod positioned in trailing relation to each of said flukes;

each of said flukes having a trailing end secured to said straight rod;

a pivot sleeve disposed in ensleeving relation to said straight rod, mid-length thereof, said pivot sleeve being rotatable about a longitudinal axis of symmetry of said straight rod;

said trailing end of said elongate shank being secured to said pivot sleeve so that said elongate shank is rotatable about the longitudinal axis of said pivot sleeve;

said slide sleeve and said first cap being complementally beveled with respect to one another so that a beveled leading end of said slide sleeve mates with a beveled trailing end of said first cap when said slide sleeve and said first cap are disposed in abutting relation to one another;

whereby a vessel operator places tension on the anchor chain means and travels toward a point on the water above an anchor engaged to an underwater obstacle while maintaining said tension;

whereby said elongate shank rotates to follow the path of travel of said vessel, said elongate shank pointing toward said vessel as said vessel travels;

whereby said slide sleeve rotates about a longitudinal axis of said elongate shank;

whereby said slide sleeve slides along the length of said elongate shank;

whereby said vessel continues along the same path of travel if said anchor does not release from said obstacle and said vessel passes over the anchor so that said vessel is traveling away from said anchor;

whereby said anchor is released from said obstacle.

2. The anchor of claim 1, further comprising:

said elongate shank being formed of stainless steel.

3. The anchor of claim 1, further comprising:

said slide sleeve being formed of stainless steel.

4. The anchor of claim 1, further comprising:

said pivot sleeve being formed of stainless steel.

5. An anchor, comprising:

an elongate shank having a trailing end adapted to be secured to an anchor;

a slide sleeve that ensleeves said elongate shank;

said slide sleeve being slideable along the extent of said elongate shank;

said slide sleeve being rotatable about a longitudinal axis of said elongate shank;

a first cap secured to a leading end of said elongate shank to prevent disengagement of said slide sleeve from said elongate shank;

a tab secured to said slide sleeve, said tab projecting radially outwardly with respect to said longitudinal axis of said elongate shank;

an aperture formed in said tab;

a loop member that extends through said aperture, said loop member adapted to be engaged by an anchor chain means;

said anchor being formed of an initially flat sheet of material having a "V"-shaped bend formed centrally thereof so that said anchor is symmetrical about said "V"-shaped bend;

said elongate shank having a bend formed therein at a trailing end thereof;

a trailing part of said elongate shank being secured to said anchor at said "V"-shaped bend;

a second cap secured to said elongate shank near said trailing part of said elongate shank, said second cap being positioned in leading relation to said bend formed in said elongate shank so that said slide sleeve is free to slide along a straight extent of said elongate shank between said first cap and said second cap;

said slide sleeve and said first cap being complementally beveled with respect to one another so that a beveled leading end of said slide sleeve mates with a beveled tailing end of said first cap when said slide sleeve and said first cap are disposed in abutting relation to one another;

whereby a vessel operator places tension on the anchor chain means and travels toward a point on the water above an anchor engaged to an underwater obstacle while maintaining said tension;

whereby said elongate shank rotates to follow the path of travel of said vessel, said elongate shank pointing toward said vessel as said vessel travels;

whereby said slide sleeve rotates about a longitudinal axis of said elongate shank;

whereby said slide sleeve slides along the length of said elongate shank;

whereby said vessel continues along the same path of travel if said anchor does not release from said obstacle and said vessel passes over the anchor so that said vessel is traveling away from said anchor;

whereby said anchor is released from said obstacle.

6. The anchor of claim 5, further comprising:

said elongate shank being formed of stainless steel.

7. The anchor of claim 5, further comprising:

said slide sleeve being formed of stainless steel.

* * * * *